US009360208B2

(12) United States Patent
Chen et al.

(10) Patent No.: US 9,360,208 B2
(45) Date of Patent: Jun. 7, 2016

(54) EASY TRANSPORTABLE VORTEX TYPE GAS LAMP

(75) Inventors: Wei-Long Chen, Taichung (TW); Jan-Nan Chen, Taichung (TW); Tammy Yen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 1216 days.

(21) Appl. No.: 13/314,250

(22) Filed: Dec. 8, 2011

(65) Prior Publication Data

US 2012/0231403 A1 Sep. 13, 2012

(30) Foreign Application Priority Data

Mar. 11, 2011 (TW) ..... 100108256 A

(51) Int. Cl.

| | |
|---|---|
| ***F21L 17/00*** | (2006.01) |
| ***F23C 7/00*** | (2006.01) |
| ***F23C 7/02*** | (2006.01) |
| ***F23D 14/28*** | (2006.01) |

(52) U.S. Cl.

CPC . *F23C 7/002* (2013.01); *F23C 7/02* (2013.01); *F23D 14/28* (2013.01)

(58) Field of Classification Search

CPC ..... F21L 17/00; F21L 19/00; F21L 26/00; F21V 35/00; F21V 37/00

USPC ..... 431/9, 353, 350; 362/161, 163

See application file for complete search history.

(56) References Cited

U.S. PATENT DOCUMENTS 7,097,448 B2 8/2006 Chesney ..... 431/353

*Primary Examiner* — Jorge Pereiro

(74) *Attorney, Agent, or Firm* — Alan D. Kamrath; Kamrath IP Lawfirm, P.A.

(57) ABSTRACT

A gas lamp includes first and second main structures. The first main structure forms a foundation of the gas lamp and includes a reservoir as a fuel tank. The second main structure is directly and releasably mounted atop of the first main structure. The second main structure includes a fluid guiding member, a carrier mechanism, a covering member, and a shield. The fluid guiding member defines a fluid entry zone and a fluid acceleration zone. The covering member includes the fluid acceleration zone circumferentially surrounded therein. The gas lamp includes the carrier mechanism adapted to be grasped, which facilitates disengagement of the first and second main structures for fuel refill and easy transportation of the second main structure.

19 Claims, 22 Drawing Sheets

EASY TRANSPORTABLE VORTEX TYPE GAS LAMP

BACKGROUND OF THE INVENTION

1. Field of the Invention

The present invention relates to a vortex type gas lamp and, particularly to, a vortex type gas lamp that is easy transportable.

2. Description of the Related Art

U.S. Pat. No. 7,097,448 to Chesney discloses a vortex type gas lamp for producing an upwardly-directed vortex flame of combustible gas inside a surrounding and confined boundary of rotating body of air. An interface is located between the body of air which is devoid of gas and a central region of gas which is bounded by the interface during the operation of the gas lamp. All of the combustion of gas substantially occurs inside the interface. The gas lamp has a central axis and includes a base supplying combustible gas without air at and nearly adjacent to the central axis. The gas lamp further includes a shield including first and second axially-extending sections structurally attached to the base in a fluid-sealing relationship. The first and second sections are substantially identical and transparent to light and each includes an impermeable wall having an arcuate inner surface and an arcuate outer surface. Moreover, each of the first and second sections has first and second edges extended axially. The gas lamp yet further includes the first and second walls alternately overlapping one another. The first and second walls are adjacent to their edges and are spaced from one another so as to form tangentially-directed ports, thereby forming an axially-extending chamber open at its side only through the ports. The first and second sections are arranged that at the base they surround the entry of the combustible gas and gas receives air for combustion only through the ports, whereby combustion of the gas results in a flame spaced from the inner surfaces and the peripheral body of air is devoid of gas entering through the ports. It is, however, not easy and safe to preclude air from entering through the ports to extinguish the flame. Additionally, Chesney discussed nothing as to how to resolve a problem if fuel for the gas lamp is used up.

The present invention is, therefore, intended to obviate or at least alleviate the problems encountered in the prior art.

SUMMARY OF THE INVENTION

According to the present invention, an easy transportable vortex type gas lamp includes first and second main structures. The first main structure forms a foundation of the gas lamp. The first main structure includes a reservoir as a fuel tank. The second main structure is directly and releasably mounted atop of the first main structure. The second main structure includes a fluid guiding member, a carrier mechanism, a covering member, and a shield. The fluid guiding member has a first distal end defining a fluid entry zone and a second distal end defining a fluid acceleration zone respectively. The fluid guiding member includes a plurality of vanes extending from the fluid entry zone to the fluid acceleration zone and circumferentially disposed and spaced from one another. Two of the vanes delimit a passage which is spiral-shaped. The covering member has an enclosed circumferential edge and includes the fluid acceleration zone circumferentially surrounded therein. Each vane in the flow acceleration zone is encircled by the covering member. Each vane in the flow intake zone is not covered by the covering member. The carrier mechanism is fixed with the fluid guiding member. The carrier mechanism bears the covering member and the shield. The carrier mechanism includes a portion defining a flange exposed outside the first main structure. The shield is hollow and transparent to light and disposed above the fluid guiding member.

Moreover, the gas lamp includes the carrier mechanism adapted to be grasped. The carrier mechanism facilitates disengagement of the first and second main structures for fuel refill and easy transportation of the second main structure. Moreover, the gas lamp includes external air induced into each passage through the fluid entry zone and exited from the fluid acceleration zone and into the shield. The external air directed and swirled and accelerated by each passage, so the gas lamp can produce a flame that is swirled and has an augmented height and a stable shape. Additionally, the flame is visible through the shield.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
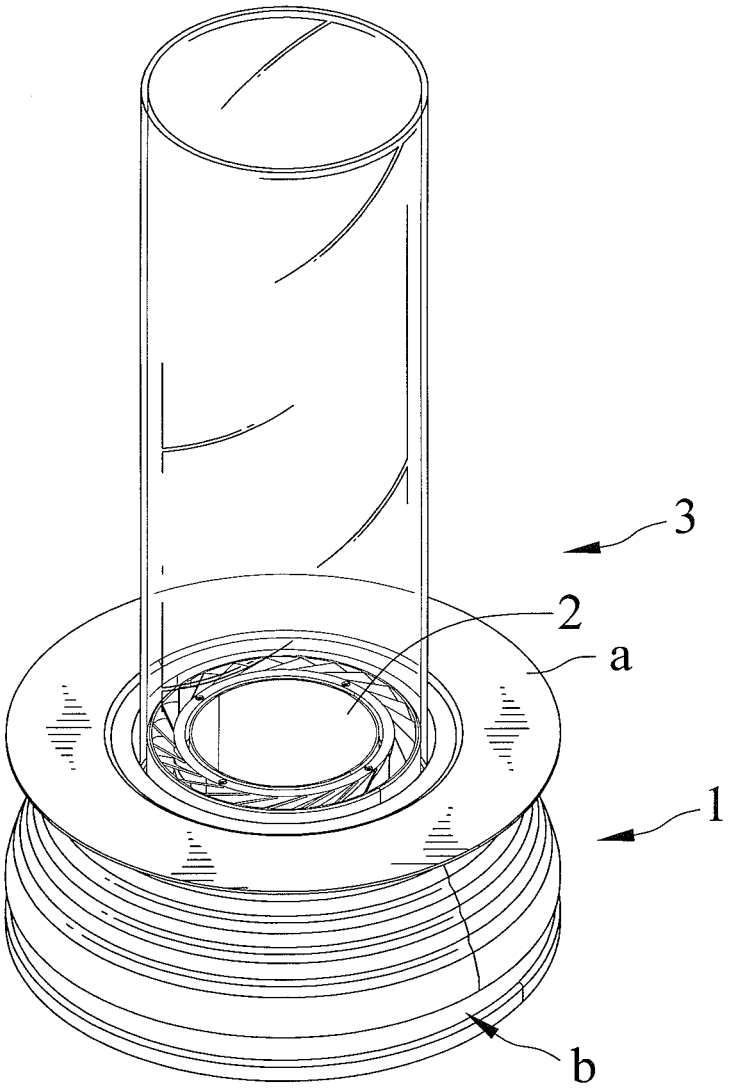
FIG. 1 is a perspective view of an easy transportable vortex type gas lamp in accordance with a first embodiment of the present invention.
Figure 2:
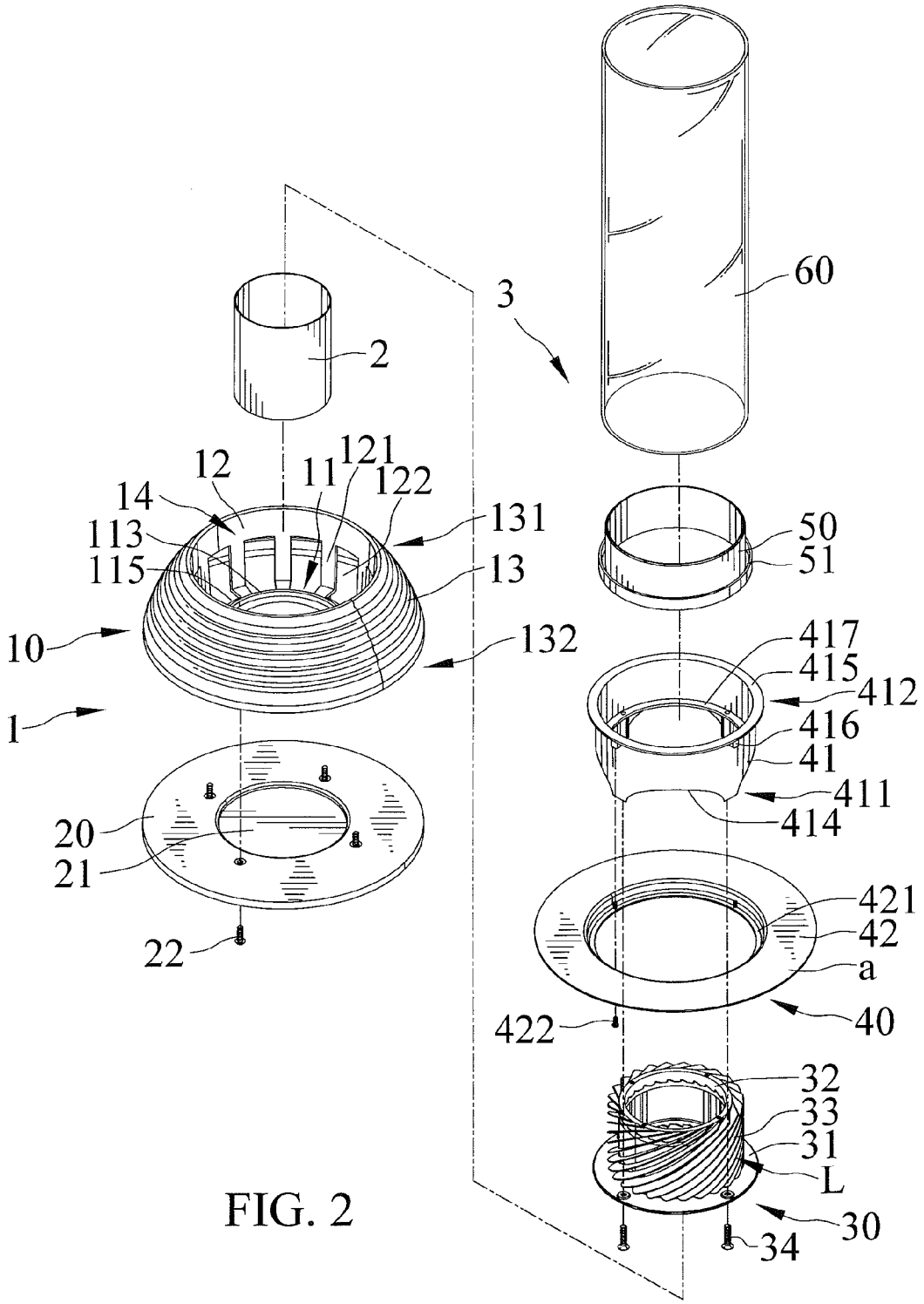
FIG. 2 is an exploded perspective view of the easy transportable vortex type gas lamp of FIG. 1.
Figure 3:
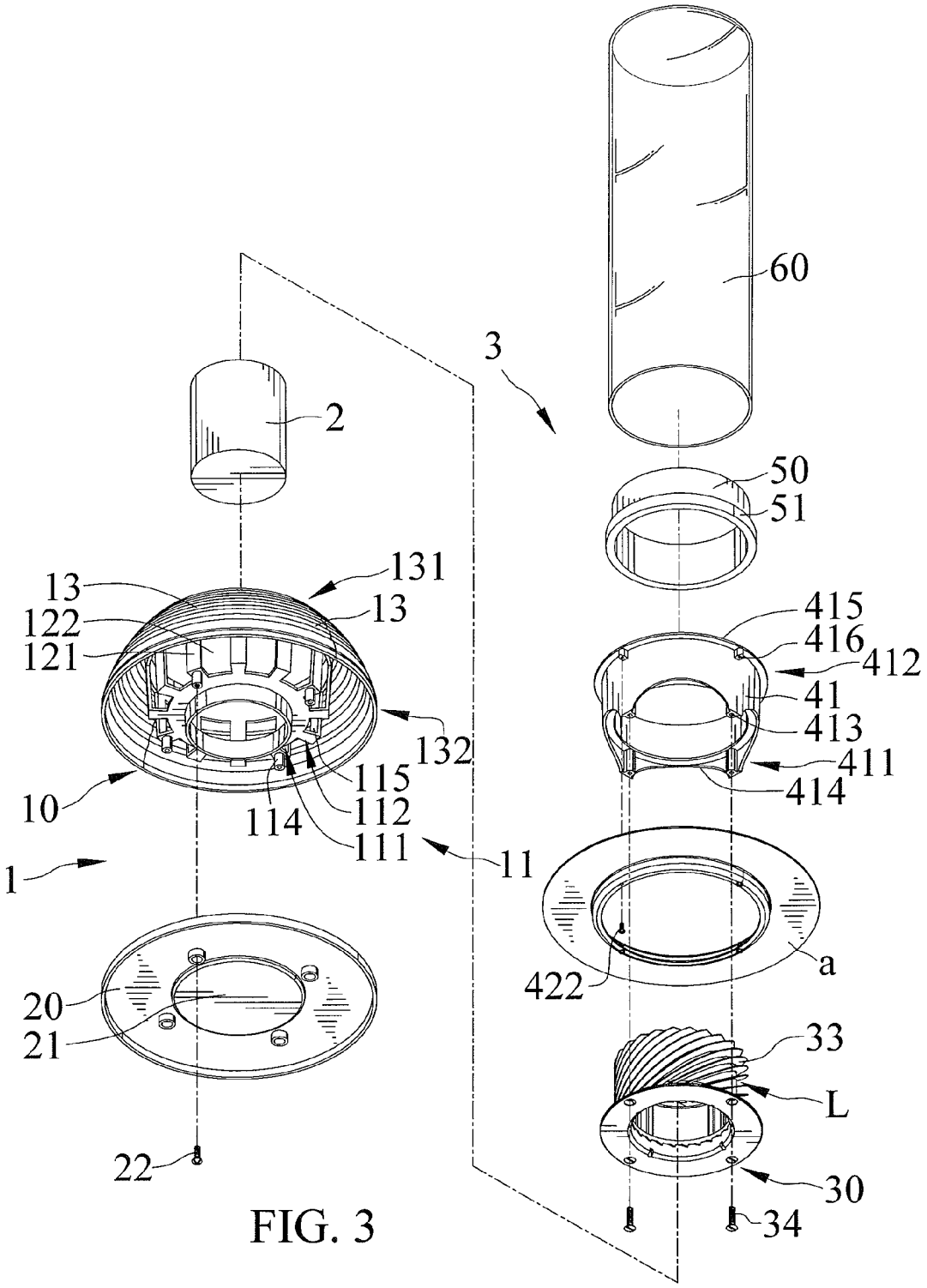
FIG. 3 is an exploded perspective view similar to FIG. 2, but taken in a different angle of view than that of FIG. 2.
Figure 4:
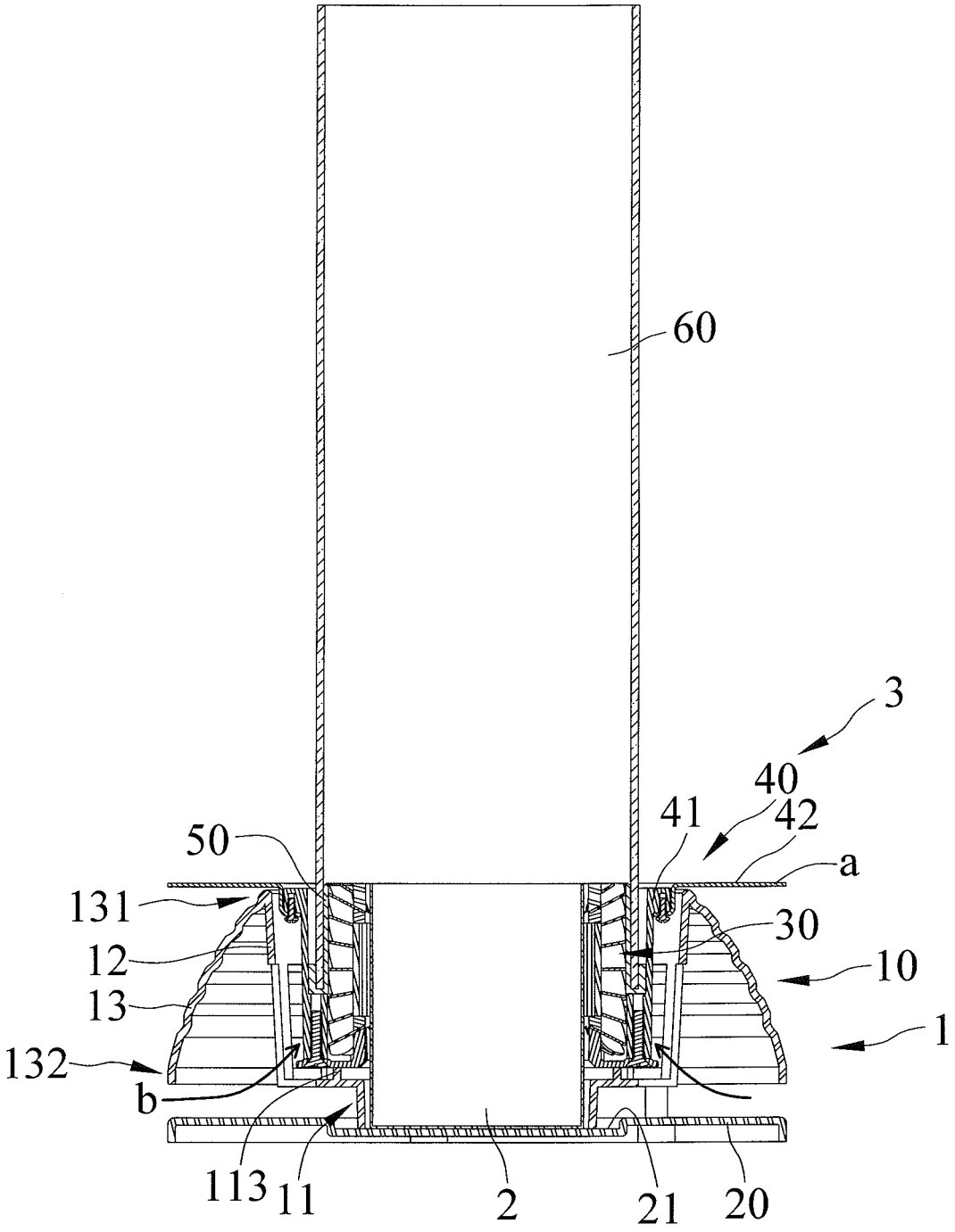
FIG. 4 is a cross-sectional view of the easy transportable vortex type gas lamp of FIG. 1.
Figure 5:
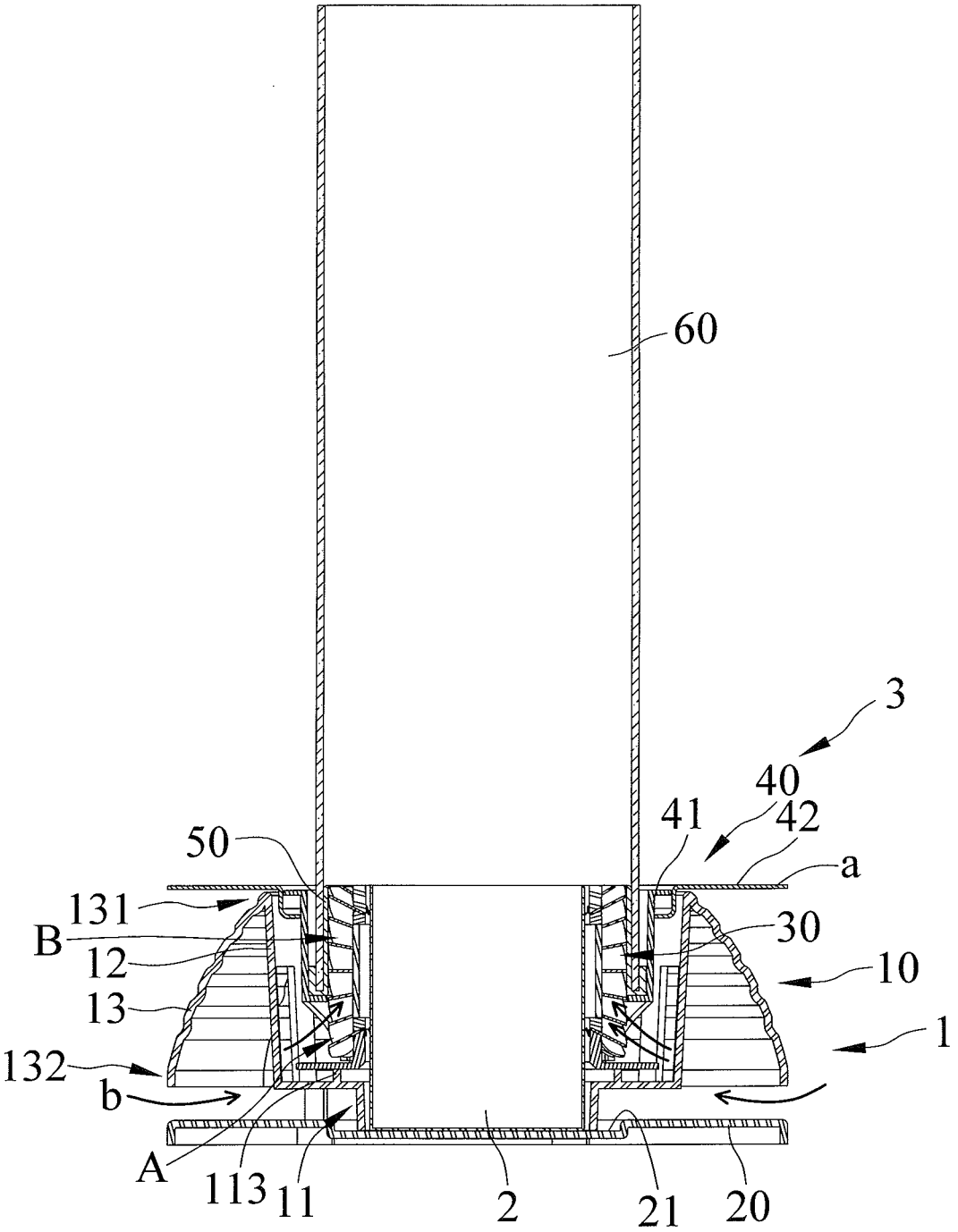
FIG. 5 illustrates arrows representing air, with the air directed into a fluid guiding member of the easy transportable vortex type gas lamp of FIG. 1.
Figure 6:
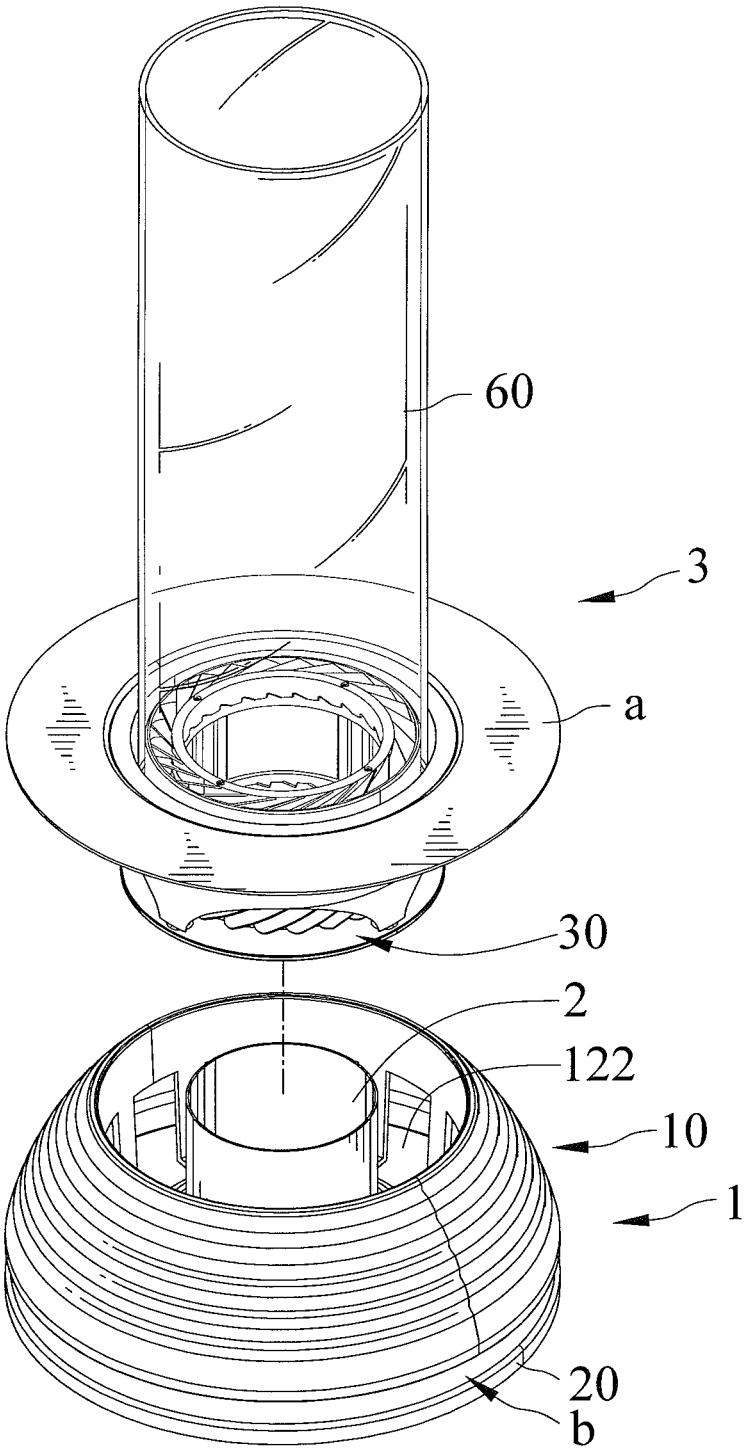
FIG. 6 is an exploded perspective view showing the easy transportable vortex type gas lamp of FIG. 1 including a combination of first and second main structures, with the first main structure releasably engagable with the second main structure.
Figure 7:
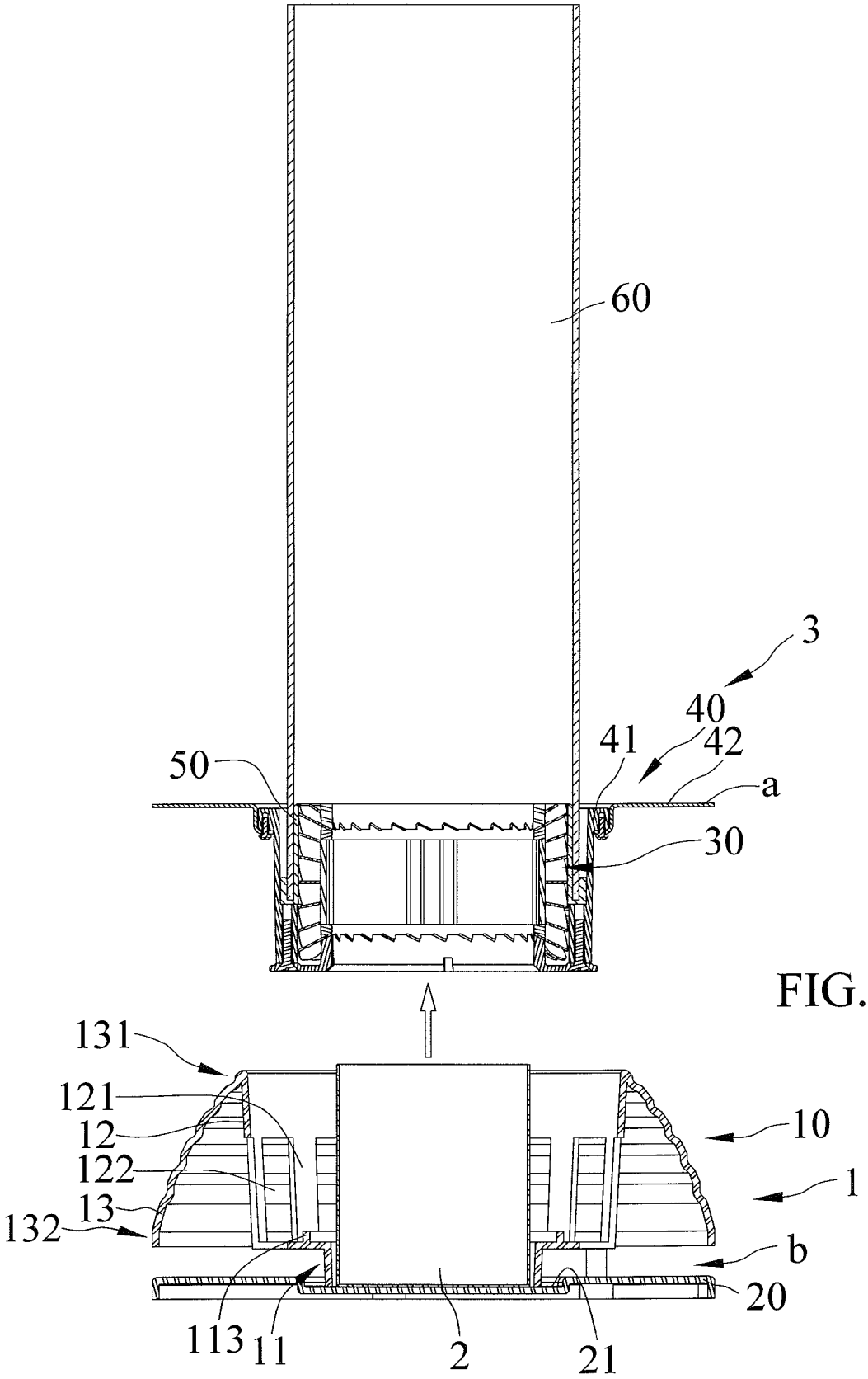
FIG. 7 is a cross-sectional view of FIG. 6.

FIGS. 1 through 7 show an easy transportable vortex type gas lamp in accordance with a first embodiment of the present invention. The gas lamp includes first and second main structures 1 and 3.

The first main structure 1 forms a foundation of the gas lamp. The first main structure 1 includes a reservoir 2 as a fuel tank, a seat 10 and a platform 20. The seat 10 is mounted on the platform 20. The seat 10 and the platform 20 include an air inlet passage b defined therebetween. The air inlet passage b includes the external air flowed thereinto. The seat 10 defines a bottom 11, an inner peripheral wall 12, and an outer peripheral wall 13. The bottom 11 includes a first wall 111 and a second wall 112. The first wall 111 includes an annular circumference. The first wall 111 includes the reservoir 2 received and retained therein. The second wall 112 includes a horizontal surface extending radially outwardly from the first wall 111. The second wall 112 and the inner peripheral wall 12 delimit a chamber 14. The chamber 14 includes the second main structure 3 partially and releasably received therein and is in fluid communication with the fluid entry zone A and the air inlet passage b. The seat 10 includes the inner peripheral wall 12 including a plurality of ribs 121 and gaps 122. Two of the plurality of ribs 121 are spaced by one of the plurality of gaps 122. Each rib 121 is extended upwardly from the bottom 11. The plurality of gaps 122 are in fluid communication with the air let passage b and the chamber 14. Also, the seat 10 includes the exterior wall 13 defining a first end 131 and a second end 132 and extended obliquely and having an increased cross section from the first end 131 to the second end 132. The exterior wall 13 includes the first end 131 connected to the inner peripheral wall 12. Additionally, the exterior wall 13 includes the second end spaced from the plurality of gaps 122 at a distance. The seat 10 further includes the second wall 112 of the bottom 11 including a protrusion 113. The protrusion 113 is extended form the second wall 112 and in the chamber 14. The protrusion 113 includes the second main structure 3 disposed thereon and elevating the second main structure 3 from the second wall 112 at a height to avoid the first main structure 1 to become overheated by the second main structure 3. The protrusion 113 includes an annular circumference. The platform 20 defines a mounting area 21 including the reservoir 2 disposed and retained thereon.

The seat 10 and the platform 20 are fastened together by at least one fastening member 22. The seat 10 includes at least one joint structure 114. The at least one joint structure 114 is extending from the second wall of the bottom 11. The at least one fastening member 22 inserted through the platform 20 and engaged with the at least one joint structure 14.

The second wall 112 includes a serrated annular circumference which includes a plurality of notches 115 formed. The plurality of notches 115 are in fluid communication with the plurality of gaps 122.

The second main structure 3 is directly and releasably mounted atop of the first main structure 1. The second main structure 3 includes a fluid guiding member 30, a carrier mechanism 40, a covering member 50, and a shield 60. The fluid guiding member 30 has a first distal end defining a fluid entry zone A and a second distal end defining a fluid acceleration zone B respectively. The fluid guiding member 30 includes a plurality of vanes 33 extending from the fluid entry zone A to the fluid acceleration zone B and circumferentially disposed and spaced from one another. Two of the vanes 33 delimit a passage L which is spiral-shaped. The covering member 50 has an enclosed circumferential edge and includes the fluid acceleration zone B circumferentially surrounded therein. Each vane 33 in the flow acceleration zone B is encircled by the covering member 50. Each vane 33 in the flow intake zone A is not covered by the covering member 50. The carrier mechanism 40 is fixed with the fluid guiding member 30. The carrier mechanism 40 bears the covering member 50 and the shield 60. The carrier mechanism 40 includes a portion defining a flange a exposed outside the first main structure 1. The carrier mechanism 40 has a cross section larger than a cross section of the first end 131 of the exterior wall 13 of the seat 10. Also, the carrier mechanism 40 includes a body 41 and a lug 42. The body 41 defines a bottom end 411 and a top end 412. The body 41 includes a peripheral wall extended from the top end 411 to the bottom end 412 and includes the bottom end 412 connected to a plate bearing the plurality of vanes 33 of the fluid guiding member 30. The body 41 and the plate of the fluid guiding member 30 are fastened together by at least one fastener 34. The at least one fastener 34 is inserted through the plate of the fluid guiding member 30 and engaged with the body 41. The body 41 includes the bottom end 411 defining at least one first fixing end 413. The at least one fastener 34 is engaged with the at least one fixing end 413. The peripheral wall of the body 41 and the plate of the fluid guiding member 30 include at least one port 414 delimited therebetween and in fluid communication with the fluid entry zone A of the fluid guiding member 30. Also, the peripheral wall of the body 41 delimits a cavity. The cavity includes the fluid guiding member 30 and the covering member 50 received therein. The lug 42 is extended radially from the peripheral wall of the body 41. The lug 42 is disposed outside the peripheral wall of the body 41. The lug 42 defines the flange a of the carrier mechanism 3. The shield 60 is hollow and transparent to light and disposed above the fluid guiding member 30.

The body 41 defines an edge 415 and includes at least one fixing structure 416. The body 41 includes an edge extended radially from the peripheral wall thereof. The at least one fixing structure 416 is extended from the edge 415. The lug 42 includes a ledge 421. The ledge 421 includes an inner edge delimiting a hole extended through the lug 42. The body 41 integrated with the lug 42 includes the at least one fixing structure 416 abutted against the ledge 421 of the lug 42 and includes at least one fixing member 422 engaged therewith, with the fixing member inserted through the ledge 421 and engaging with the fixing structure 416. The ledge 421 has a substantially L-shaped cross section. Also, the body 41 includes a ridge 417 extended radially from the peripheral wall thereof and in the cavity.

The covering member 50 includes channel 51 extended circumferentially. The covering member 50 bears the shield 60 including an end of the shield 60 received and retained in the channel 51.

Moreover, the gas lamp includes the carrier mechanism 40 adapted to be grasped. The carrier mechanism 40 facilitates disengagement of the first and second main structures 1 and 3 for fuel refill and easy transportation of the second main structure 3. Moreover, the gas lamp includes external air induced into each passage L through the fluid entry zone A and exited from the fluid acceleration zone B and into the shield 60. The external air is directed and swirled and accelerated by each passage L, so the gas lamp can produce a flame that is swirled and has an augmented height and a stable shape. Additionally, the flame is visible through the shield 60.

Figure 8:
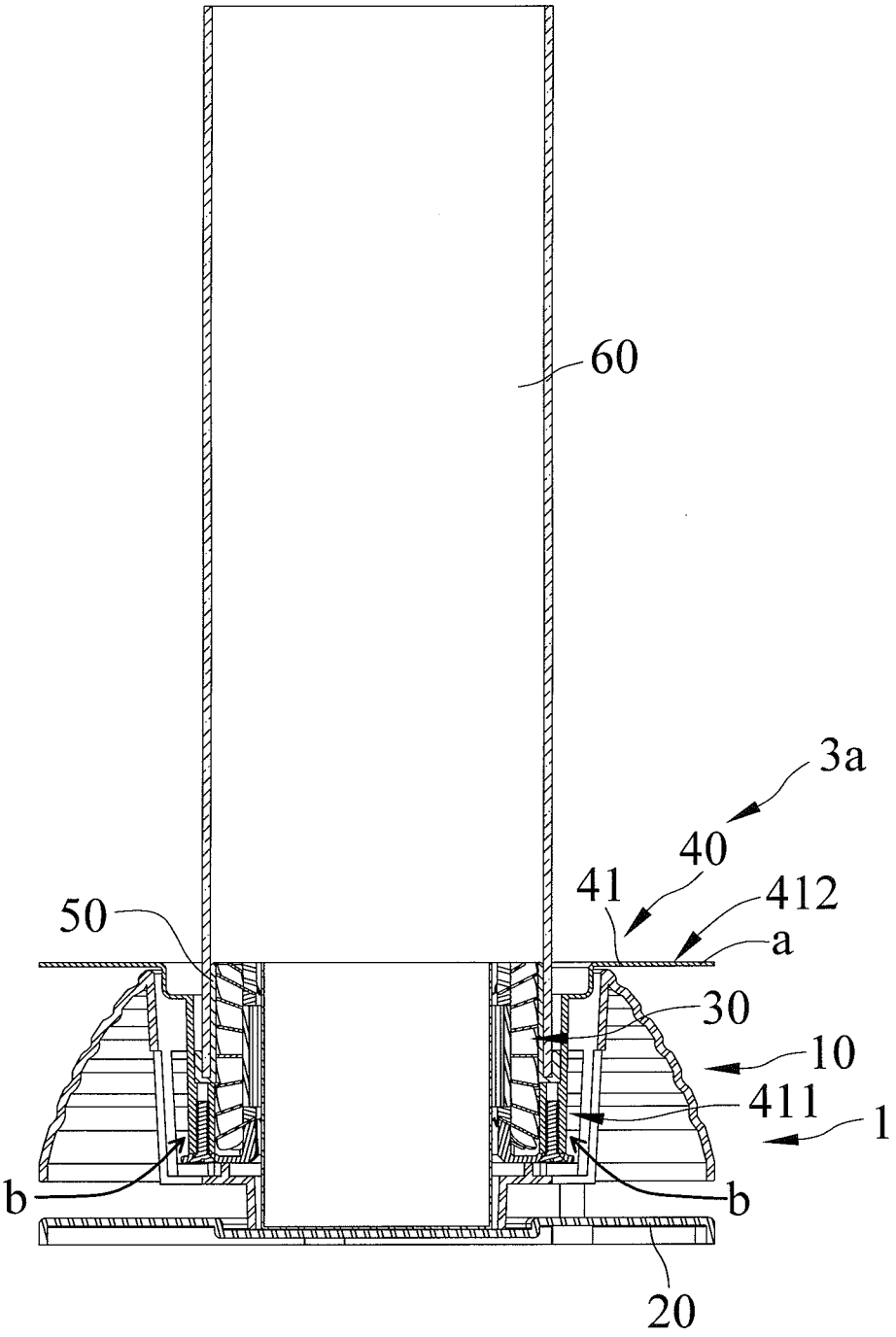
FIG. 8 is a cross-sectional view of an easy transportable vortex type gas lamp in accordance with a second embodiment of the present invention.
Figure 9:
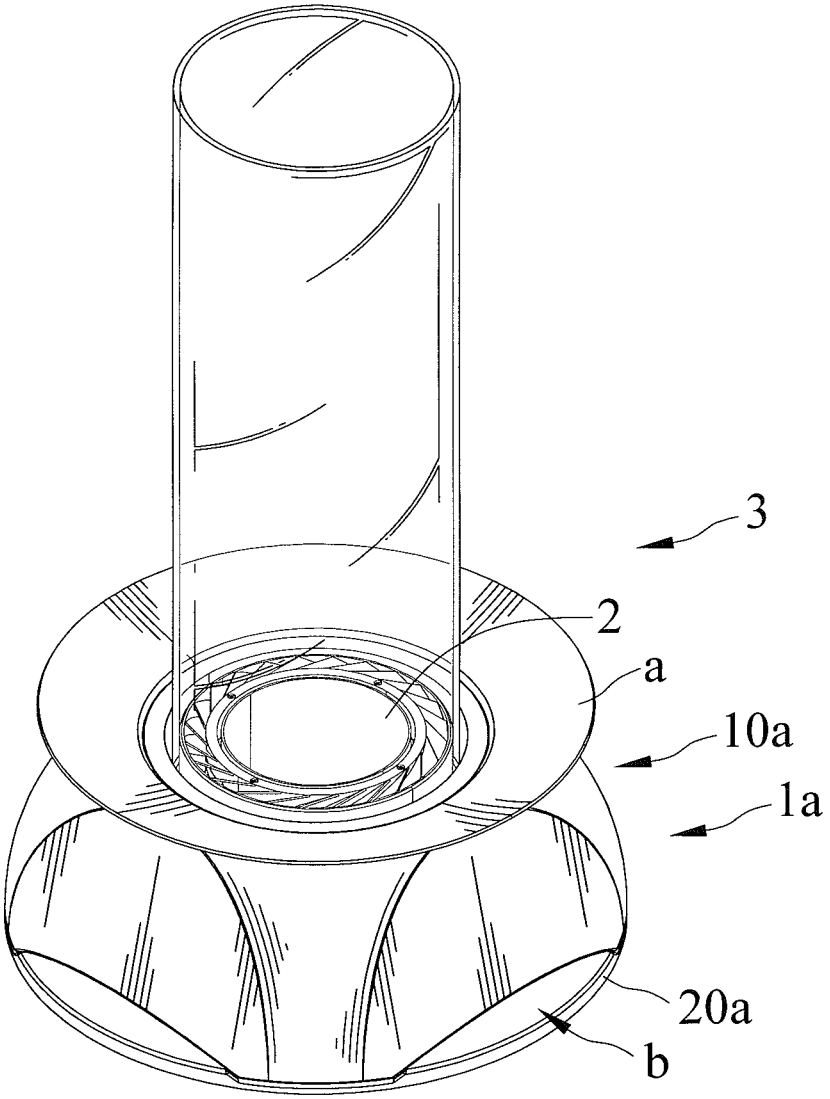
FIG. 9 is a cross-sectional view of an easy transportable vortex type gas lamp in accordance with a third embodiment of the present invention.
Figure 10:
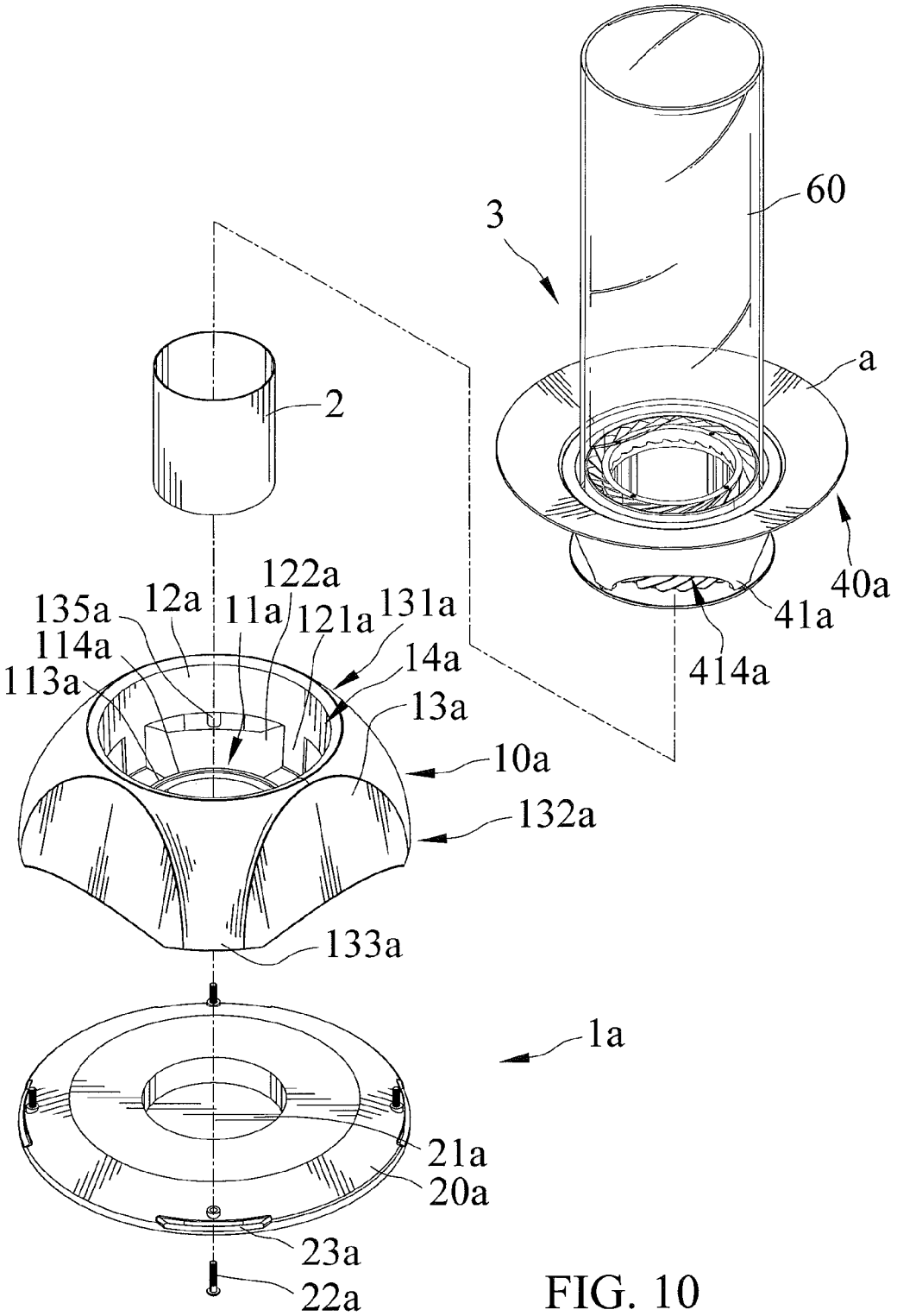
FIG. 10 is an exploded perspective view of the easy transportable vortex type gas lamp of FIG. 9.
Figure 11:
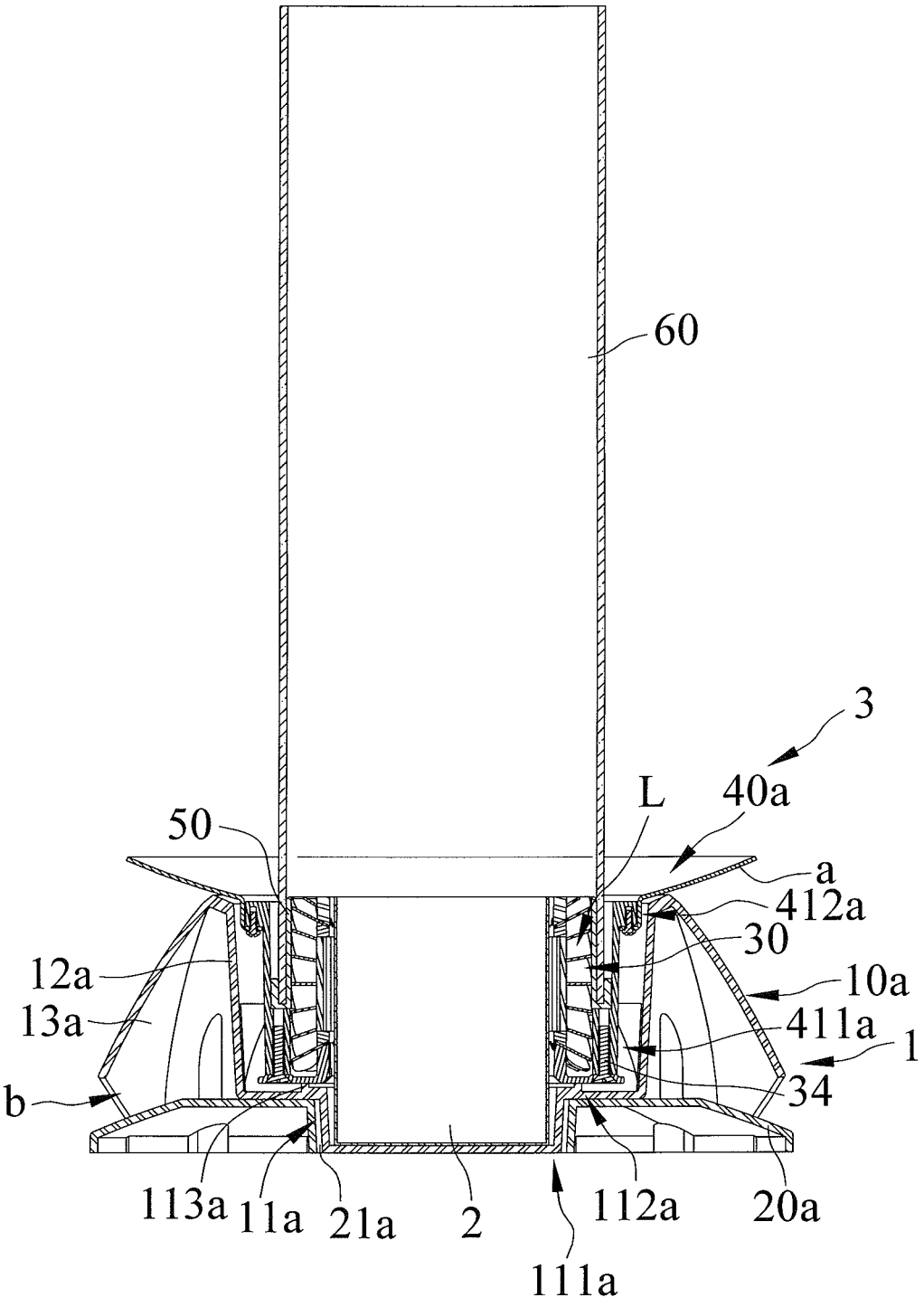
FIG. 11 is a cross-sectional view of FIG. 10 of the easy transportable vortex type gas lamp of FIG. 9.
Figure 12:
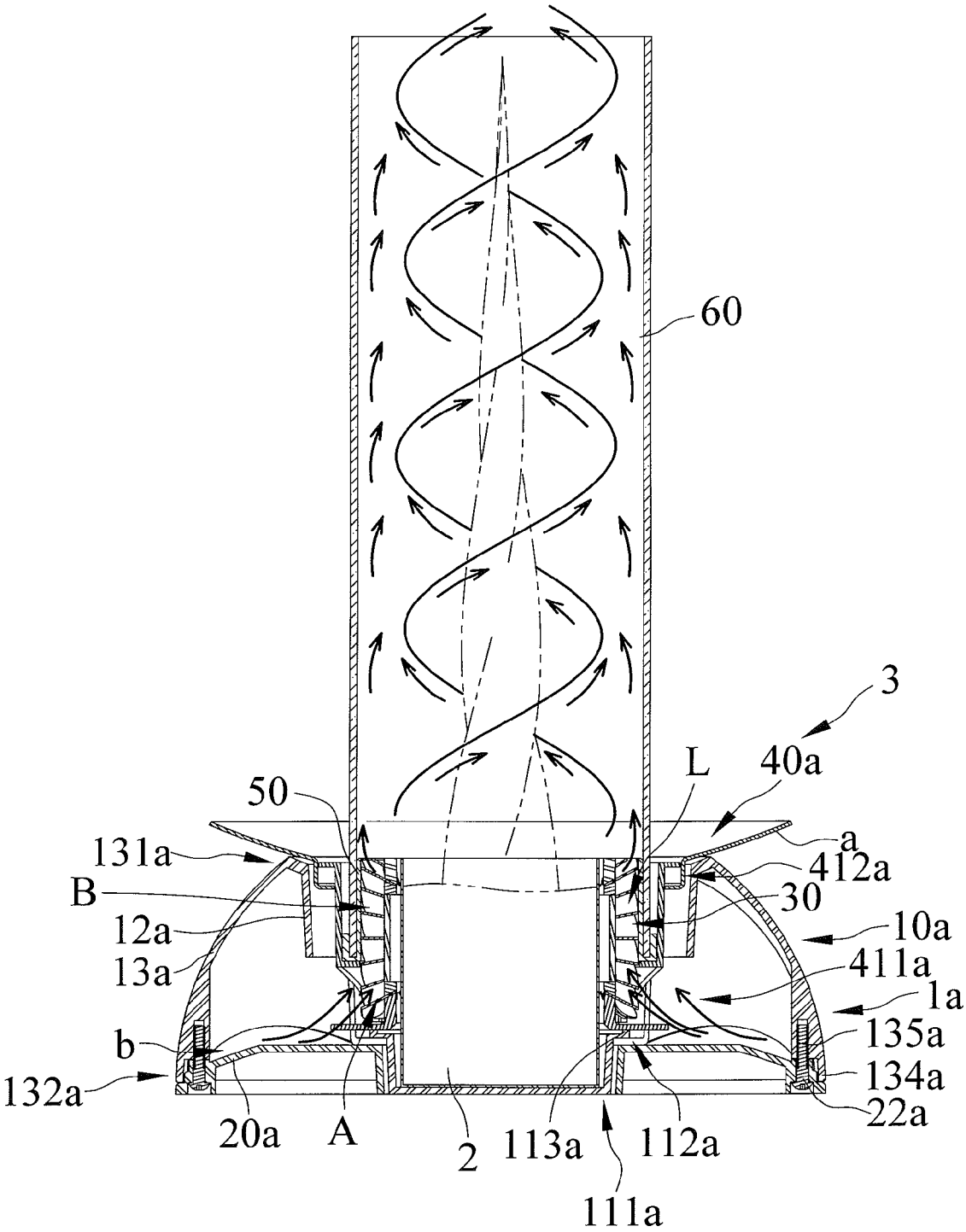
FIG. 12 illustrates the easy transportable vortex type gas lamp of FIG. 9 producing a flame vortex after igniting fuel received therein and illustrates arrows representing air, with the flame vortex and the fuel shown in phantom.
Figure 13:
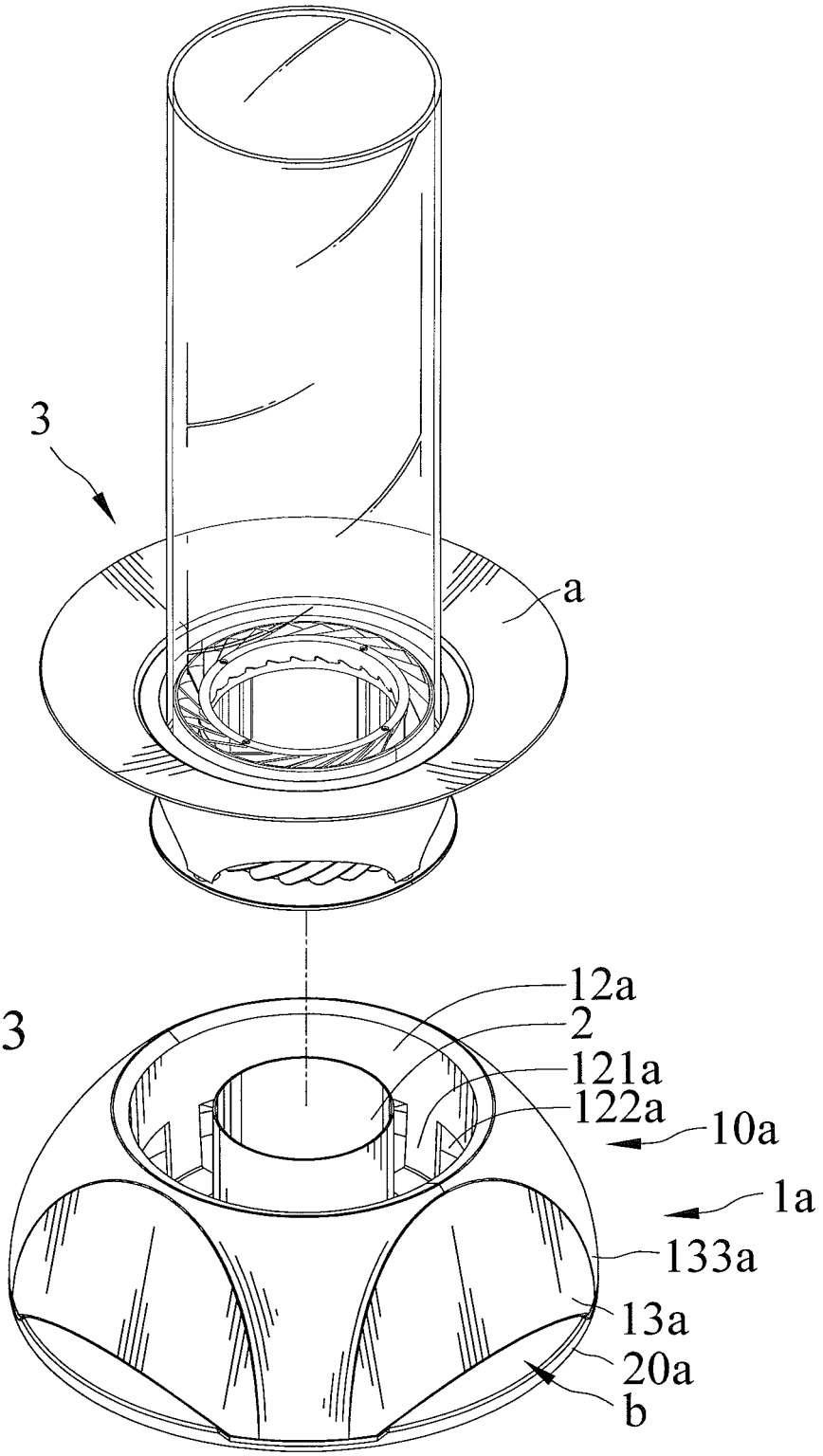
FIG. 13 is an exploded perspective view showing the easy transportable vortex type gas lamp of FIG. 9 including a combination of first and second main structures, with the first main structure releasably engagable with the second main structure.
Figure 14:
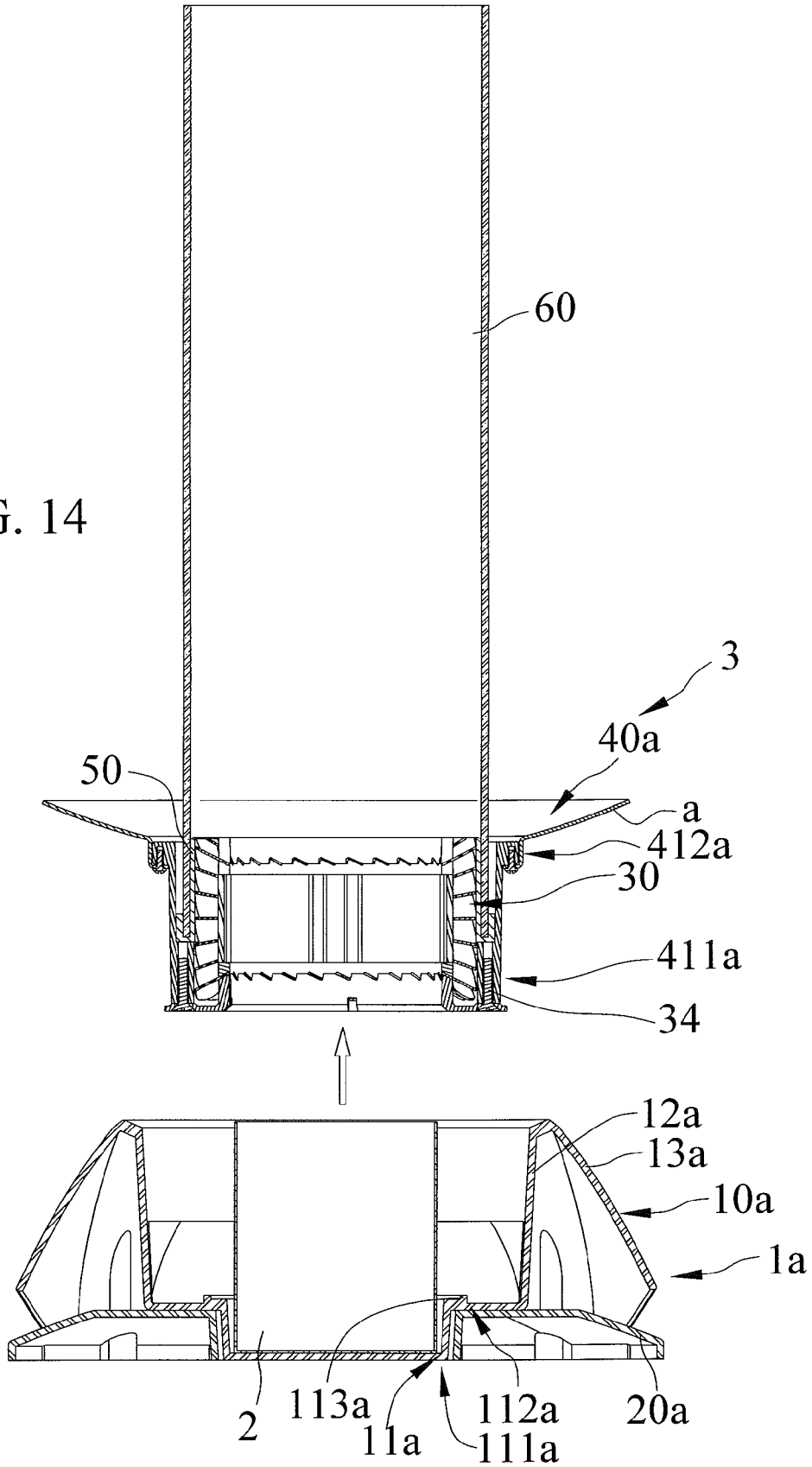
FIG. 14 is a cross-sectional view of FIG. 13.
Figure 15:
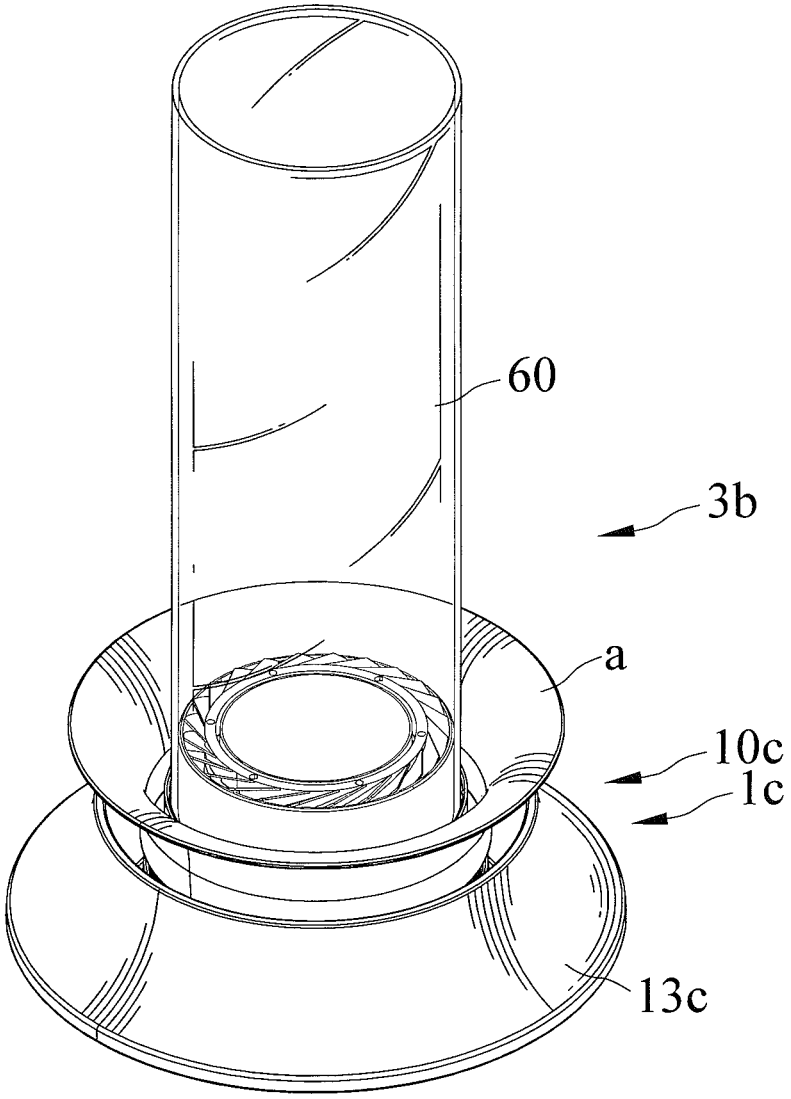
FIG. 15 is a cross-sectional view of an easy transportable vortex type gas lamp in accordance with a third embodiment of the present invention.
Figure 16:
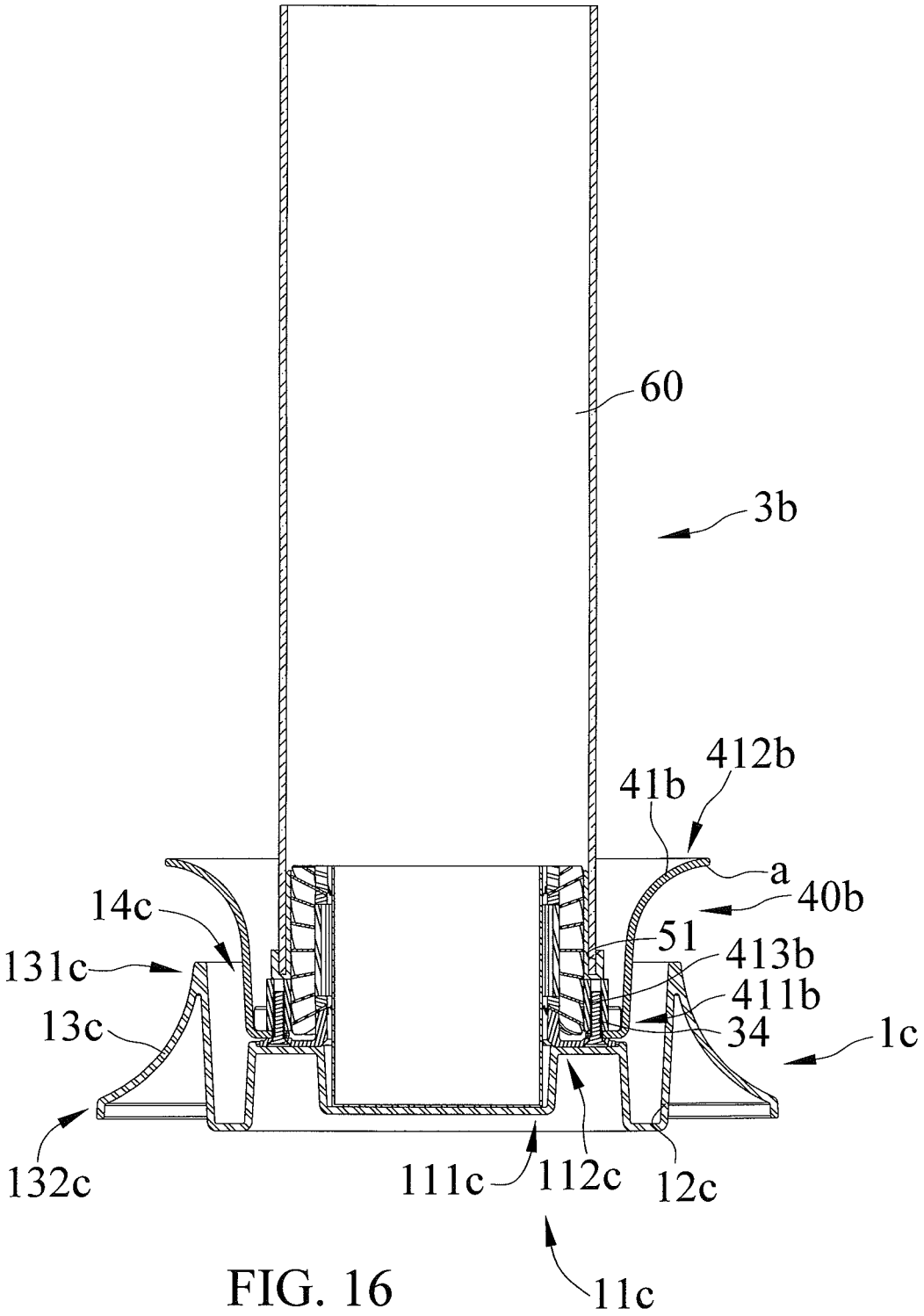
FIG. 16 is a cross-sectional view of the easy transportable vortex type gas lamp of FIG. 15.
Figure 17:
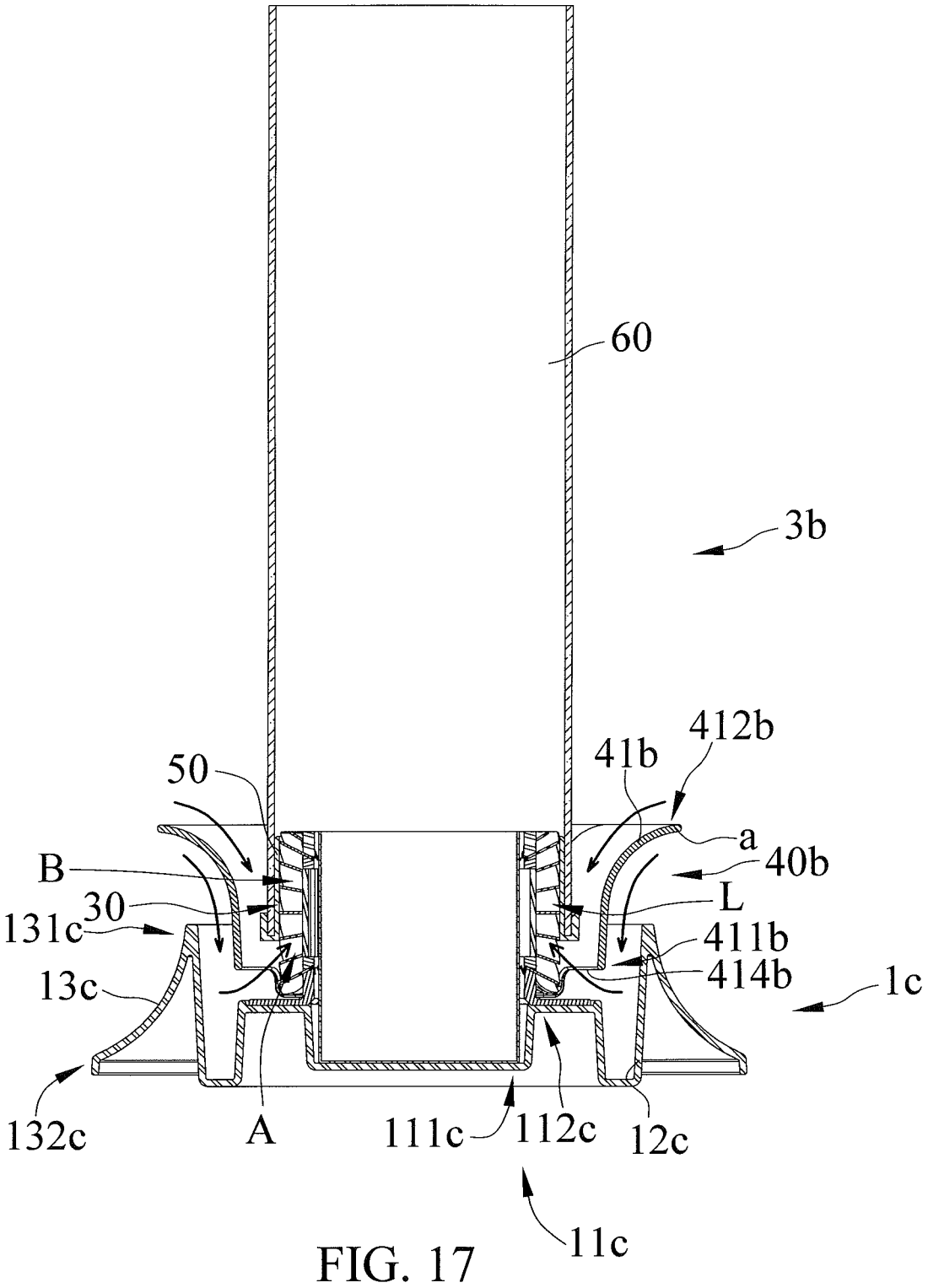
FIG. 17 illustrates arrows representing air, with the air directed into a fluid guiding member of the easy transportable vortex type gas lamp of FIG. 15.
Figure 18:
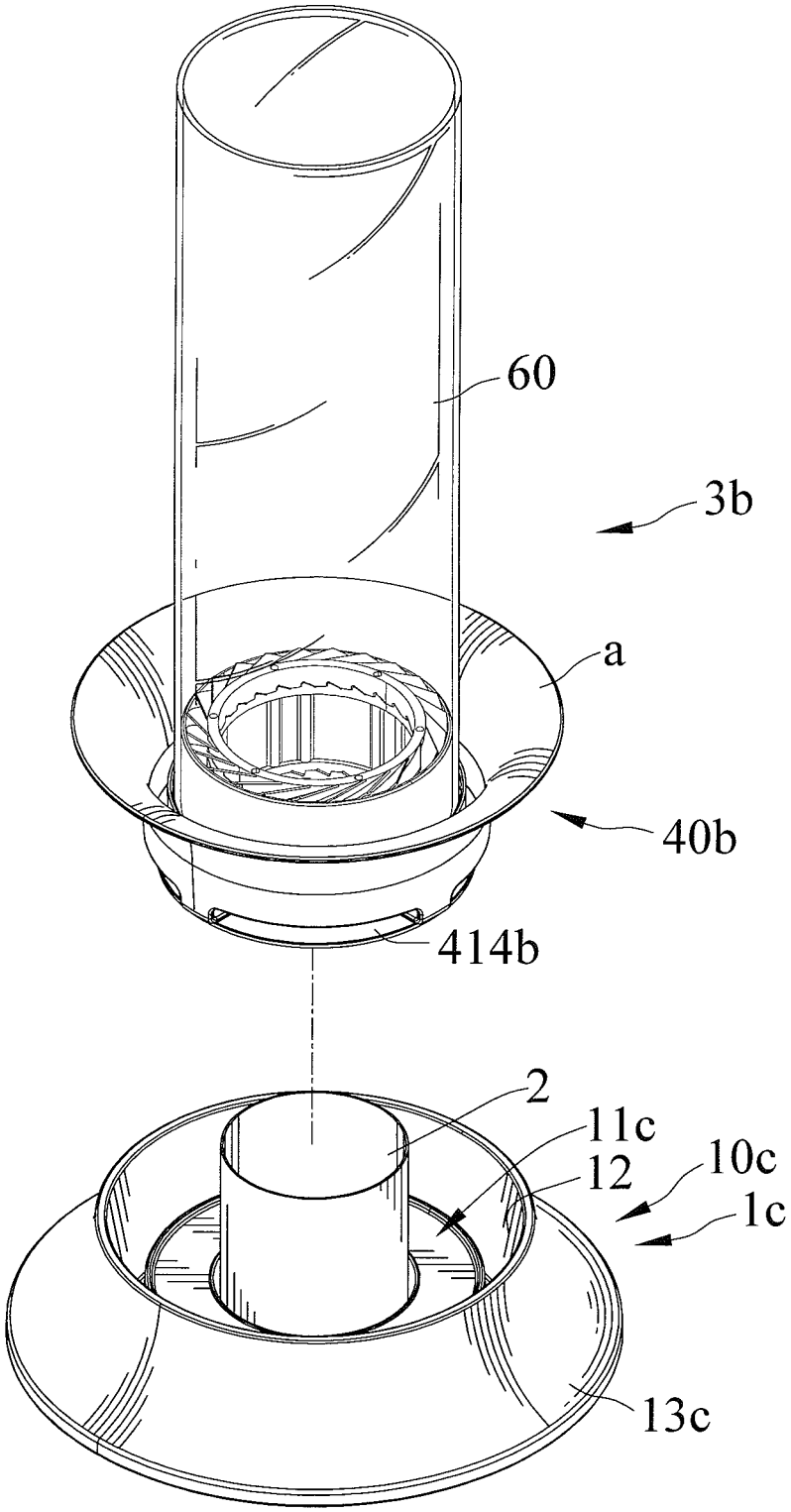
FIG. 18 is an exploded perspective view showing the easy transportable vortex type gas lamp of FIG. 15 including a combination of first and second main structures, with the first main structure releasably engagable with the second main structure.
Figure 19:
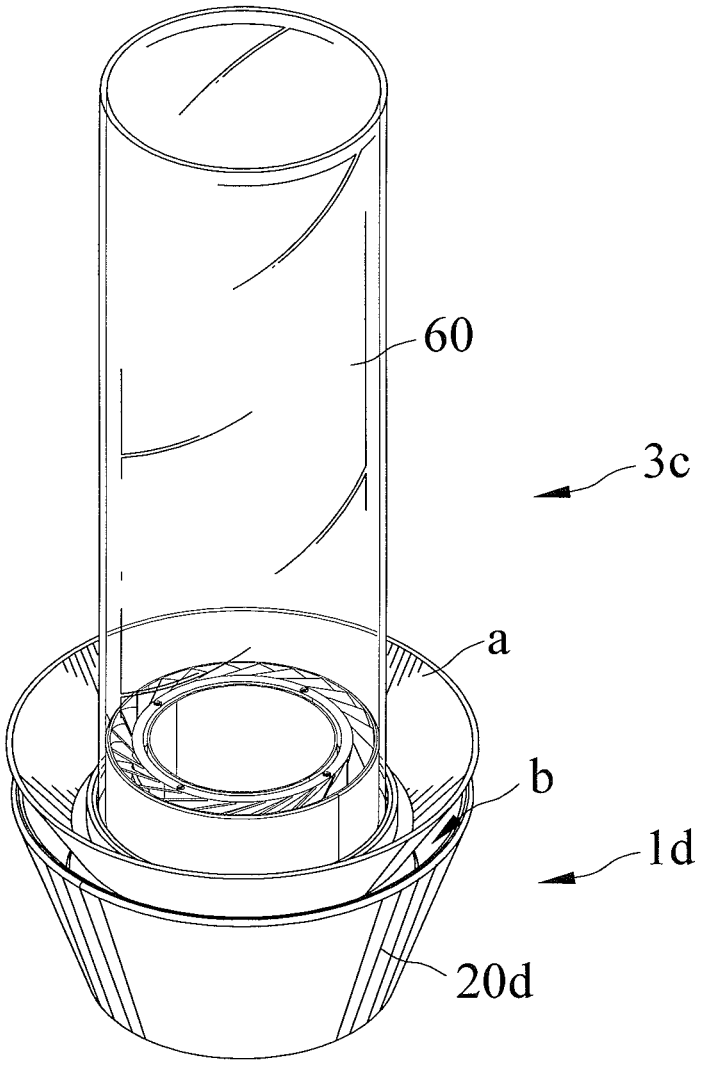
FIG. 19 is a cross-sectional view of an easy transportable vortex type gas lamp in accordance with a fifth embodiment of the present invention
Figure 20:
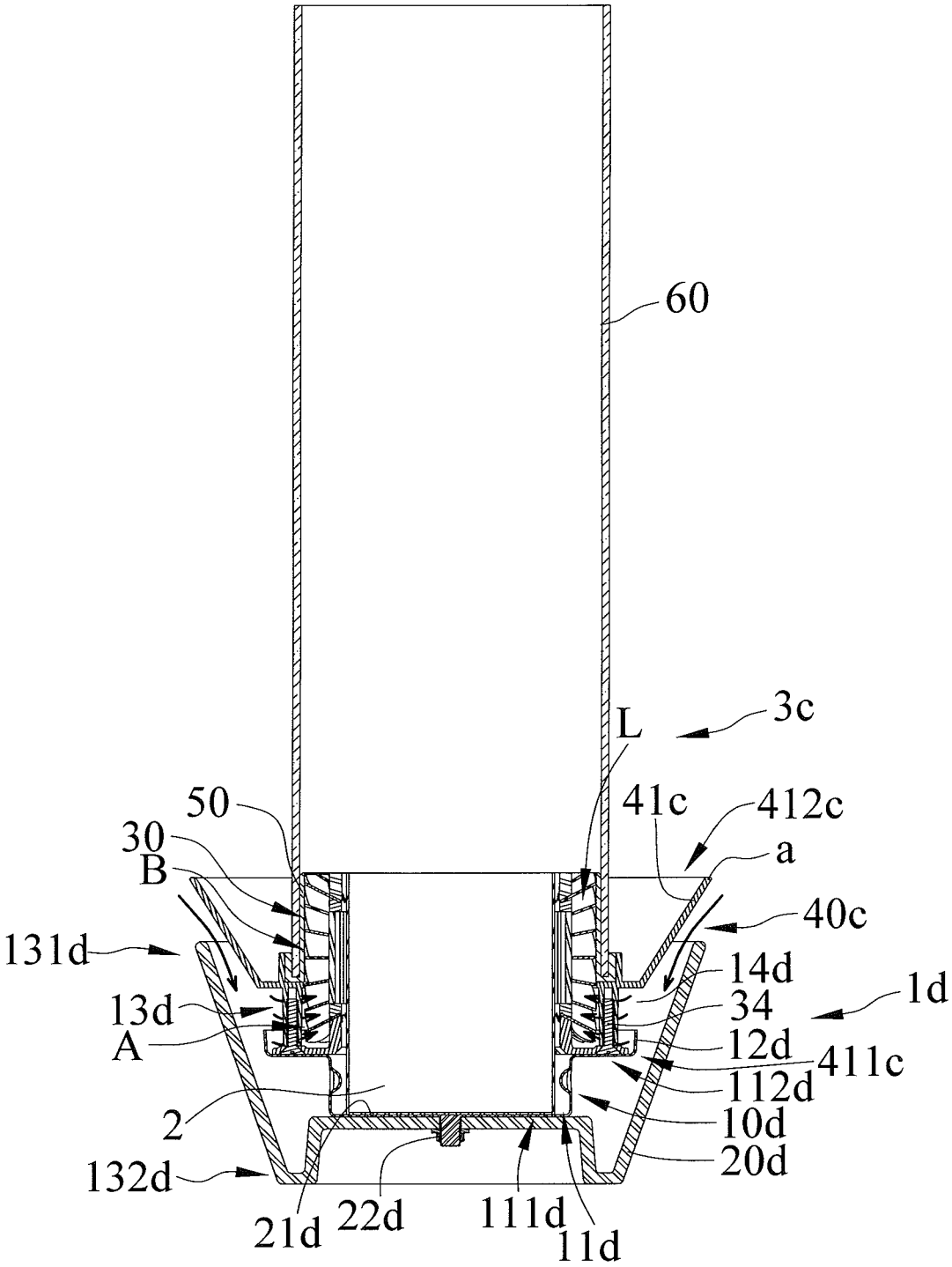
FIG. 20 is a cross-sectional view of the easy transportable vortex type gas lamp of FIG. 19.
Figure 21:
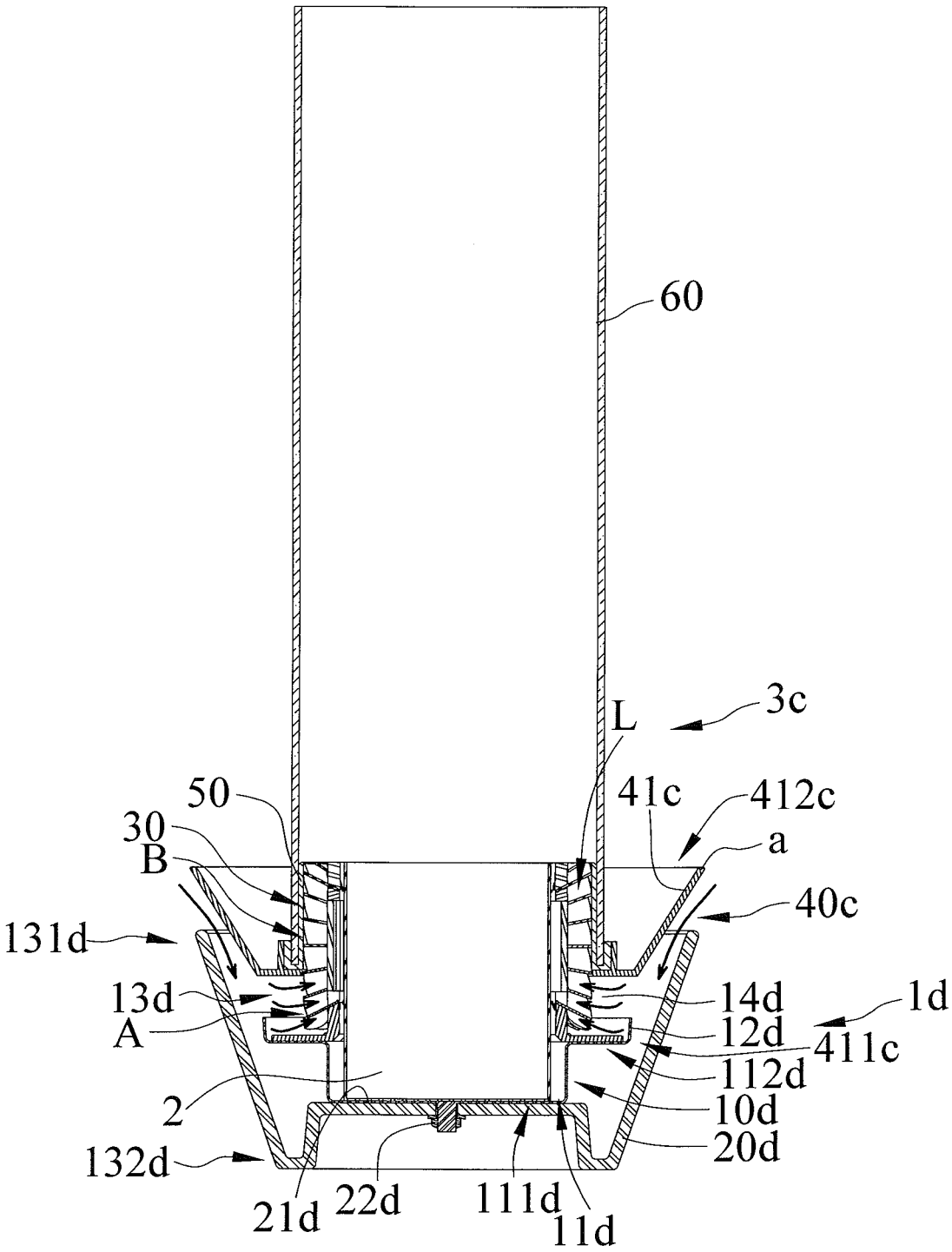
FIG. 21 illustrates arrows representing air, with the air directed into a fluid guiding member of the easy transportable vortex type gas lamp of FIG. 19.
Figure 22:
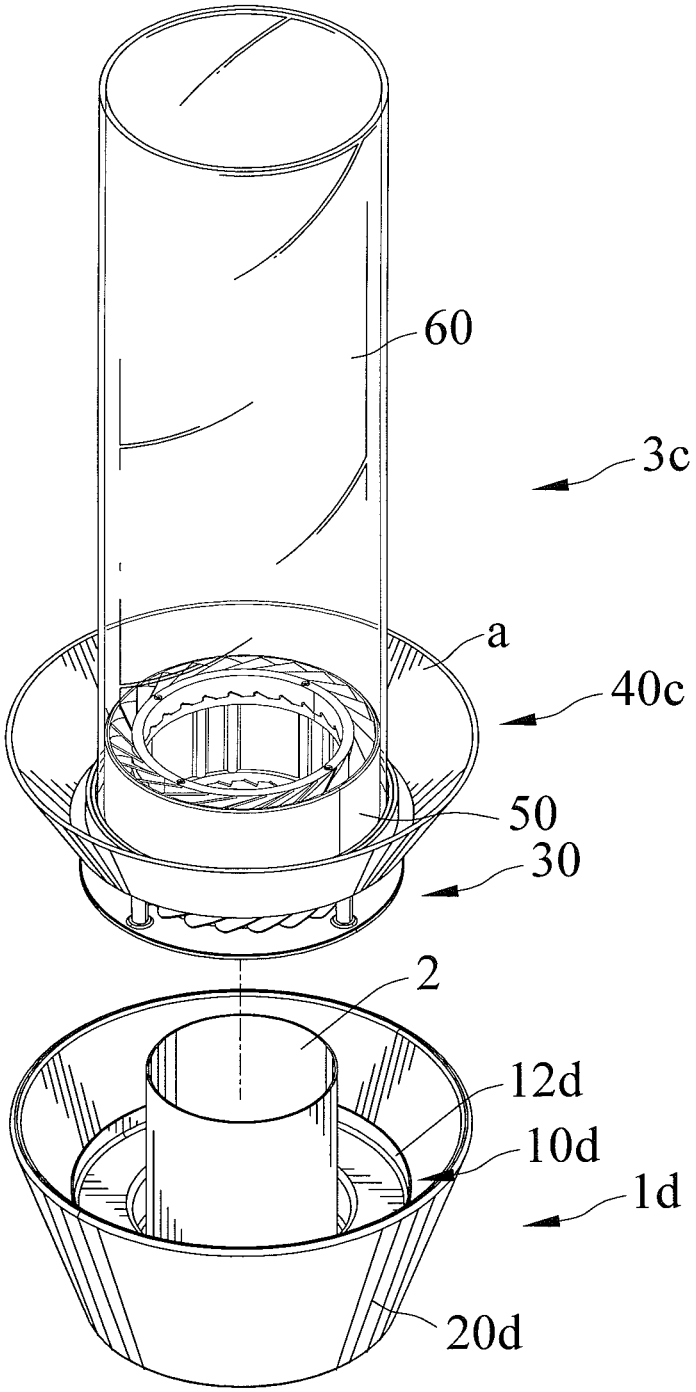
FIG. 22 is an exploded perspective view showing the easy transportable vortex type gas lamp of FIG. 19 including a combination of first and second main structures, with the first main structure releasably engagable with the second main structure.

FIG. 8 shows an easy transportable vortex type gas lamp in accordance with a second embodiment of the present invention. The second embodiment is the same as the first embodiment except that body 41 and the lug 42 are formed as one piece.

FIGS. 9 through 14 show an easy transportable vortex type gas lamp in accordance with a third embodiment of the present invention. The gas lamp includes first and second main structures 1*a* and 3. The first main structure 1*a* includes a seat 10*a* and a platform 20*a*. The seat 10*a* is mounted on the platform 20*a*. The seat 10*a* and the platform 20*a* include an air inlet passage b defined therebetween. The air inlet passage b includes the external air flowed thereinto. The seat 10*a* defines a bottom 11*a*, an inner peripheral wall 12*a*, and an outer peripheral wall 13*a*. The bottom 11*a* includes a first wall 111*a* and a second wall 112*a*. The first wall 111*a* includes an annular circumference. The first wall 111*a* includes the reservoir 2 received and retained therein. The second wall 112*a* includes a horizontal surface extending radially outwardly from the first wall 111*a*. The second wall 112*a* and the inner peripheral wall 12*a* delimit a chamber 14*a*. The chamber 14*a* includes the second main structure 3 partially and releasably received therein and is in fluid communication with the fluid entry zone A and the air inlet passage b. The seat 10*a* includes the inner peripheral wall 12*a* including a plurality of ribs 121*a* and gaps 122*a*. Two of the plurality of ribs 121*a* are spaced by one of the plurality of gaps 122*a*. Each rib 121*a* is extended upwardly from the bottom 11*a*. The plurality of gaps 122*a* are in fluid communication with the air let passage b and the chamber 14*a*. Also, the seat 10*a* includes the exterior wall 13*a* defining a first end 131*a* and a second end 132*a* and extended obliquely and having an increased cross section from the first end 131*a* to the second end 132*a*. The exterior wall 13*a* includes the first end 131*a* connected to the inner peripheral wall 12*a*. Additionally, the exterior wall 13*a* includes the second end spaced from the plurality of gaps 122*a* at a distance. The seat 10*a* further includes the second wall 112*a* of the bottom 11*a* including a protrusion 113*a*. The protrusion 113*a* is extended form the second wall 112*a* and in the chamber 14*a*. The protrusion 113*a* includes the second main structure 3 disposed thereon and elevating the second main structure 3 from the second wall 112*a* at a height to avoid the first main structure 1*a* to become overheated by the second main structure 3. The protrusion 113*a* includes an annular circumference. The platform 20*a* defines a mounting area 21*a* including the reservoir disposed and retained thereon.

The seat 10*a* and the platform 20*a* are fastened together by a plurality of fastening member 22*a*. The exterior wall 13*a* of the seat 10*a* including a plurality of corners 133*a* each including a connecting structure 134*a* formed. The connecting structure 134*a* defines an engaging section 135*a*. One of the plurality of fastening members 22*a* is inserted through the platform 20*a* and engaged with the engaging section of the connecting structure 134*a* on each corner 133*a*. Furthermore, the seat 10*a* includes the bottom 11 a including a plurality of standing sections defined on the plurality of corners 133*a* respectively. The seat 10*a* engaged with the platform 20*a* include the plurality of standing sections received in a plurality of recess 23*a* inset in the platform 20*a*.

The second main structure 3 includes the fluid guiding member 30, a carrier mechanism 40*a*, the covering member 50, and the shield 60. The carrier mechanism 40*a* has a cross section larger than a cross section of the first end 131*a* of the exterior wall 13*a* of the seat 10*a*. The carrier mechanism 40*a* includes a body 41*a* and a lug 42*a*. The body 41*a* defines a bottom end 411*a* and a top end 412*a*. The body 41*a* includes a peripheral wall extended from the top end 411*a* to the bottom end 412*a* and includes the bottom end 412*a* connected to a plate bearing the plurality of vanes 33 of the fluid guiding member 30. The body 41*a* and the plate of the fluid guiding member 30 are fastened together by at least one fastener 34. The at least one fastener 34 is inserted through the plate of the fluid guiding member 30 and engaged with the body 41*a*. The peripheral wall of the body 41*a* and the plate of the fluid guiding member 30 include at least one port 414*a* delimited therebetween and in fluid communication with the fluid entry zone A of the fluid guiding member 30. Also, the peripheral wall of the body 41*a* delimits a cavity. The cavity includes the fluid guiding member 30 and the covering member 50 received therein. The lug 42*a* is extended radially from the peripheral wall of the body 41*a*. The lug 42*a* is disposed outside the peripheral wall of the body 41*a*. The lug 42*a* defines the flange a of the carrier mechanism 3.

FIGS. 15 through 18 show an easy transportable vortex type gas lamp in accordance with a fourth embodiment of the present invention. The gas lamp includes first and second main structures 1*c* and 3*b*. The first main structure 1*c* includes a seat 10*c*. The seat 10*c* defines a bottom 11*c*, an inner peripheral wall 12*c*, and an outer peripheral wall 13*c* and includes the second main structure 3*b* directly and releasably mounted thereon. The bottom 11*c* includes a first wall 111*c* and a second wall 112*c*. The first wall 111*c* includes an annular circumference. The first wall 111*c* includes the reservoir 2 received and retained therein. The second wall 112*c* includes a horizontal surface extending radially outwardly from the first wall 111*c*. The second wall 112*c* and the inner peripheral wall 12*c* delimit a chamber 14*c*. The chamber 14*c* includes the external air flowed thereinto. The chamber 14*c* also includes the second main structure 3*b* partially and releasably received therein and is in fluid communication with the fluid entry zone A. The chamber 14*c* includes the fluid guiding member 3 disposed therein. The seat 10*c* includes the exterior wall 13*c* defining a first end 131*c* and a second end 132*c* and extended obliquely and having a decreased cross section from the first end 131*c* to the second end 132.

The second main structure 3*b* includes the fluid guiding member 30, a carrier mechanism 40*b*, the covering member 50, and the shield 60. The carrier mechanism 40*b* includes a body 41*b*. The body 41*b* defines a bottom end 411*b* and a top end 412*b*. The body 41*b* includes a peripheral wall extending from the top end 411*b* to the bottom end 412*b* and includes the bottom end 412*b* connected to a plate bearing the plurality of vanes 33 of the fluid guiding member 30. The body 41*b* and the plate of the fluid guiding member 30 are fastened together by at least one fastener 34. The at least one fastener 34 is inserted through the plate of the fluid guiding member 30 and engaged with the body 41*b*. The body 41*b* includes the bottom end 411*b* defining at least one first fixing end 413*b*. The at least one fastener 34 is engaged with the at least one fixing end 413*b*. The peripheral wall of the body 41*b* and the plate of the fluid guiding member 30 include at least one port 414*b* delimited therebetween and in fluid communication with the fluid entry zone A of the fluid guiding member 30. The peripheral wall of the body 41*b* delimits a cavity. The cavity includes the fluid guiding member 30 and the covering member 50 received therein. Also, the peripheral wall of the body 41*b* defines the flange a of the carrier mechanism 3*b*. Additionally, the peripheral wall of the body 41*b* is extended curvedly from the bottom end 411*b* to the top end 412*b* thereof.

FIGS. 19 through 22 show an easy transportable vortex type gas lamp in accordance with a fifth embodiment of the present invention. The gas lamp includes first and second main structures 1*d* and 3*c*. The first main structure 1*d* includes a seat 10*d* and a platform 20*d*. The seat 10*d* is mounted on the platform 20. An interior of the platform 20 delimits a receptacle. The seat 10*d* is disposed in the receptacle. The seat 10*d* defines a bottom 11*d*, an inner peripheral wall 12*d*, and an outer peripheral wall 13*d*. The bottom 11*d* includes a first wall 111*d* and a second wall 112*d*. The first wall 111*d* includes an annular circumference. The first wall 111*d* includes the reservoir 2 received and retained therein. The second wall 112*d* includes a horizontal surface extending radially outwardly from the first wall 111*d*. The second wall 112*d* and the inner peripheral wall 12*d* delimit a chamber 14*d*. The chamber 14*d* includes the external air flowed thereinto and includes the second main structure 3*c* partially and releasably received therein and in fluid communication with the fluid entry zone A. The seat 10*d* includes the exterior wall 13*d* defining a first end 131*d* and a second end 132*d* and extended obliquely and having an decreased cross section from the first end 131*d* to the second end 132*d*. The platform 20*d* defines a mounting area 21*d* including the reservoir disposed and retained thereon.

The second main structure 3*c* includes the fluid guiding member 30, a carrier mechanism 40*c*, the covering member 50, and the shield 60. The carrier mechanism 40*c* includes a body 41*c*. The body 41*c* defines a bottom end 411*c* and a top end 412*c*. The body 41*c* includes a peripheral wall extending from the top end 411*c* to the bottom end 412*c* and includes the bottom end 412*c* connected to a plate bearing the plurality of vanes 33 of the fluid guiding member 30. The body 41*c* and the plate of the fluid guiding member 30 are fastened together by at least one fastener 34. The at least one fastener 34 is inserted through the plate of the fluid guiding member 30 and engaged with the body 41*c*. The peripheral wall of the body 41*c* and the plate of the fluid guiding member 30 include at least one port 414*c* delimited therebetween and in fluid communication with the fluid entry zone A of the fluid guiding member 30. The peripheral wall of the body 41*c* delimits a cavity. The cavity includes the fluid guiding member 30 and the covering member 50 received therein. Also, the peripheral wall of the body 41*c* defines the flange a of the carrier mechanism 3*c*. Additionally, the peripheral wall of the body 41*c* is extended slopedly from the bottom end 411*c* to the top end 412*c* thereof.

While the specific embodiments have been illustrated and described, numerous modifications come to mind without significantly departing from the spirit of invention, and the scope of invention is only limited by the scope of the accompanying claims.

What is claimed is:

1. An easy transportable vortex type gas lamp comprising:

a first main structure forming a foundation of the gas lamp and including a reservoir as a fuel tank; and a second main structure directly and releasably mounted atop of the first main structure and including a fluid guiding member, a carrier mechanism, a covering member, and a shield, with the fluid guiding member having a first distal end defining a fluid entry zone and a second distal end defining a fluid acceleration zone respectively and including a plurality of vanes extending from the fluid entry zone to the fluid acceleration zone and circumferentially disposed and spaced from one another, with two of the plurality of vanes delimiting a passage which is spiral-shaped, with the covering member having an enclosed circumferential edge and including the fluid acceleration zone circumferentially surrounded therein, with each vane in the flow acceleration zone encircled by the covering member, with each vane in the flow intake zone not covered by the covering member, with the carrier mechanism fixed with the fluid guiding member and bearing the covering member and the shield, with the carrier mechanism including a portion defining a flange exposed outside the first main structure, with the shield being hollow and transparent to light and disposed above the fluid guiding member;

wherein the carrier mechanism is adapted to be grasped and facilitates disengagement of the first and second main structures for fuel refill and easy transportation of the second main structure; and wherein the gas lamp includes external air induced into each passage through the fluid entry zone and exited from the fluid acceleration zone and into the shield thereafter, with the external air directed and swirled and accelerated by each passage and the gas lamp producing a flame that would be swirled and has an augmented height and a stable shape, with the flame visible through the shield.

2. The easy transportable vortex type gas lamp as claimed in claim 1, wherein the first main structure includes a seat and a platform, with the seat mounted on the platform, with the seat and the platform including an air inlet passage defined therebetween, with the air inlet passage including the external air flowed thereinto, with the seat defining a bottom, an inner peripheral wall, and an outer peripheral wall, with the bottom including a first wall and a second wall, with the first wall including an annular circumference, with the first wall including the reservoir received and retained therein, with the second wall including a horizontal surface extending radially outwardly from the first wall, with the second wall and the inner peripheral wall delimiting a chamber, with the chamber including the second main structure partially and releasably received therein and in fluid communication with the fluid entry zone and the air inlet passage, wherein the platform defines a mounting area including the reservoir disposed and retained thereon.

3. The easy transportable vortex type gas lamp as claimed in claim 2, wherein the seat includes the inner peripheral wall including a plurality of ribs and gaps, with two of the plurality of ribs spaced by one of the plurality of gaps, with each rib extended upwardly from the bottom, with the plurality of gaps in fluid communication with the air let passage and the chamber.

4. The easy transportable vortex type gas lamp as claimed in claim 3, wherein the seat includes the exterior wall defining a first end and a second end and extended obliquely and having an increased cross section from the first end to the second end, with the exterior wall including the first end connected to the inner peripheral wall, with the exterior wall including the second end spaced from the plurality of gaps at a distance.

5. The easy transportable vortex type gas lamp as claimed in claim 4, wherein the carrier mechanism has a cross section larger than a cross section of the first end of the exterior wall of the seat.

6. The easy transportable vortex type gas lamp as claimed in claim 3, wherein the seat includes the exterior wall defining a first end and a second end and extended obliquely and having a decreased cross section from the first end to the second end.

7. The easy transportable vortex type gas lamp as claimed in claim 2, wherein the seat includes the second wall of the bottom including a protrusion, with the protrusion extended form the second wall and in the chamber, with the protrusion including the second main structure disposed thereon and elevating the second main structure from the second wall at a height to avoid the first main structure to become overheated by the second main structure, wherein the protrusion includes an annular circumference.

8. The easy transportable vortex type gas lamp as claimed in claim 2, wherein the seat and the platform are fastened together by at least one fastening member, with the seat including at least one joint structure, with the at least one joint structure extended from the second wall of the bottom, with the at least one fastening member inserted through the platform and engaged with the at least one joint structure.

9. The easy transportable vortex type gas lamp as claimed in claim 2, wherein the second wall includes a serrated annular circumference which includes a plurality of notches formed, with the plurality of notches in fluid communication with the plurality of gaps.

10. The easy transportable vortex type gas lamp as claimed in claim 1, wherein the first main structure includes a seat, with the seat defining a bottom, an inner peripheral wall, and an outer peripheral wall and including the second main structure directly and releasably mounted thereon, with the bottom including a first wall and a second wall, with the first wall including an annular circumference, with the first wall including the reservoir received and retained therein, with the second wall including a horizontal surface extending radially outwardly from the first wall, with the second wall and the inner peripheral wall delimiting a chamber, with the chamber including the external air flowed thereinto and including the second main structure partially and releasably received therein and in fluid communication with the fluid entry zone, with the chamber including the fluid guiding member disposed therein.

11. The easy transportable vortex type gas lamp as claimed in claim 1, wherein the first main structure includes a seat and a platform, with the seat mounted on the platform, with an interior of the platform delimiting a receptacle, with the seat disposed in the receptacle, with the seat defining a bottom, an inner peripheral wall, and an outer peripheral wall, with the bottom including a first wall and a second wall, with the first wall including an annular circumference, with the first wall including the reservoir received and retained therein, with the second wall including a horizontal surface extending radially outwardly from the first wall, with the second wall and the inner peripheral wall delimiting a chamber, with the chamber including the external air flowed thereinto and including the second main structure partially and releasably received therein and in fluid communication with the fluid entry zone, wherein the platform defines a mounting area including the reservoir disposed and retained thereon.

12. The easy transportable vortex type gas lamp as claimed in claim 11, wherein the seat includes the exterior wall defining a first end and a second end and extended obliquely and having a decreased cross section from the first end to the second end.

13. The easy transportable vortex type gas lamp as claimed in claim 11, wherein the seat and the platform are fastened together by a plurality of fastening member, with the exterior wall of the seat including a plurality of corners each including a connecting structure formed, with the connecting structure defining an engaging section, with one of the plurality of fastening members inserted through the platform and engaged with the engaging section of the connecting structure on each corner.

14. The easy transportable vortex type gas lamp as claimed in claim 13, wherein the seat includes the bottom including a plurality of standing sections defined on the plurality of corners respectively, with the seat engaged with the platform including the plurality of standing sections received in a plurality of recess inset in the platform.

15. The easy transportable vortex type gas lamp as claimed in claim 1, wherein the carrier mechanism includes a body and a lug, with the body defining a bottom end and a top end, with the body including a peripheral wall extended from the top end to the bottom end and including the bottom end connected to a plate bearing the plurality of vanes of the fluid guiding member, with the peripheral wall of the body delimiting a cavity, with the cavity including the fluid guiding member and the covering member received therein, with the lug extended radially from the peripheral wall of the body, with the lug disposed outside the peripheral wall of the body, with the lug defining the flange of the carrier mechanism.

16. The easy transportable vortex type gas lamp as claimed in claim 15, wherein the carrier mechanism includes a body, with the body defining a bottom end and a top end, with the body including a peripheral wall extending from the top end to the bottom end and including the bottom end connected to a plate bearing the plurality of vanes of the fluid guiding member, with the peripheral wall of the body delimiting a cavity, with the cavity including the fluid guiding member and the covering member received therein, with the peripheral wall of the body defining the flange of the carrier mechanism.

17. The easy transportable vortex type gas lamp as claimed in claim 16, wherein the peripheral wall of the body of the carrier mechanism and the plate of the fluid guiding member includes at least one port delimited therebetween and in fluid communication with the fluid entry zone of the fluid guiding member.

18. The easy transportable vortex type gas lamp as claimed in claim 15, wherein the peripheral wall of the body of the carrier mechanism and the plate of the fluid guiding member include at least one port delimited therebetween and in fluid communication with the fluid entry zone of the fluid guiding member.

19. The easy transportable vortex type gas lamp as claimed in claim 1, wherein the body of the carrier mechanism and the plate of the fluid guiding member are fastened together by at least one fastener, with the at least one fastener inserted through the plate of the fluid guiding member and engaged with the body of the carrier mechanism.

* * * * *